US010864969B2

(12) United States Patent
Neto

(10) Patent No.: US 10,864,969 B2
(45) Date of Patent: Dec. 15, 2020

(54) STRUCTURAL ARRANGEMENT FOR A WATER SKI OR UNDERWATER SKI

(71) Applicant: José Chaves Neto, Balneario Camboriu (BR)

(72) Inventor: José Chaves Neto, Balneario Camboriu (BR)

( * ) Notice: Subject to any disclaimer, the term of this patent is extended or adjusted under 35 U.S.C. 154(b) by 0 days.

(21) Appl. No.: 16/468,468

(22) PCT Filed: Dec. 21, 2016

(86) PCT No.: PCT/BR2016/050341
§ 371 (c)(1),
(2) Date: Jun. 11, 2019

(87) PCT Pub. No.: WO2018/107252
PCT Pub. Date: Jun. 21, 2018

(65) Prior Publication Data

US 2020/0086957 A1 Mar. 19, 2020

(30) Foreign Application Priority Data

Dec. 15, 2016 (BR) ..... 102016029472

(51) Int. Cl.

| | |
|---|---|
| ***B63B 32/20*** | (2020.01) |
| ***B63B 32/30*** | (2020.01) |
| ***B63B 34/40*** | (2020.01) |
| ***B63H 25/02*** | (2006.01) |
| ***B63B 34/60*** | (2020.01) |

(52) U.S. Cl.
CPC ..... *B63B 32/20* (2020.02); *B63B 32/35* (2020.02); *B63B 34/60* (2020.02); *B63H 25/02* (2013.01); *B63B 2203/00* (2013.01); *B63H 2025/024* (2013.01); *B63H 2025/028* (2013.01)

(58) Field of Classification Search
CPC ..... B63B 32/20; B63B 32/35; B63B 34/60; B63H 25/02; B63H 2025/024; B63H 2025/028
See application file for complete search history.

(56) References Cited

U.S. PATENT DOCUMENTS 2,259,804 A * 10/1941 Davis ..... B62B 13/10 180/182
2,817,101 A * 12/1957 Chaffee ..... B63B 34/10 114/55.55
3,827,391 A * 8/1974 Stanberry, Sr. ..... B63B 34/10 114/274

(Continued)

*Primary Examiner* — Lars A Olson
*Assistant Examiner* — Jovon E Hayes
(74) *Attorney, Agent, or Firm* — Scott Houtteman; Houtteman Law LLC

(57) ABSTRACT

Structural arrangement for a water ski or underwater ski comprising essential mechanisms for significantly improving the user experience in underwater wake bodyboarding. The ski is characterized by the addition of novel and different attachable items that enable the ski to be used without a powered vehicle. The ski is also characterized in that it has various different items that can be attached to the cowling to improve the performance and comfort of the equipment, combined with a personalized steering system and an essential safety system, providing a model that is unique on the underwater ski/water ski market.

3 Claims, 12 Drawing Sheets

(56) References Cited

U.S. PATENT DOCUMENTS

| | | | | |
|---|---|---|---|---|
| 4,641,599 | A * | 2/1987 | Thomas | B63H 23/26 114/346 |
| 5,544,607 | A * | 8/1996 | Rorabaugh | B60F 3/0046 114/123 |
| 2020/0086957 | A1 * | 3/2020 | Neto | B63H 25/02 |

* cited by examiner

Fig. 1A
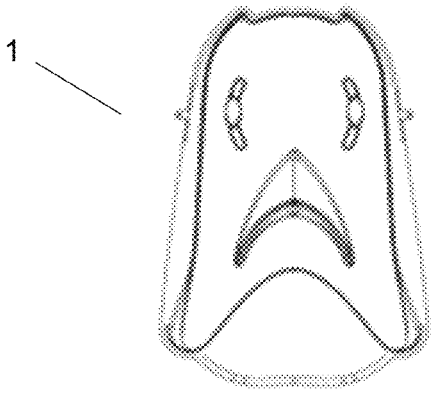
Fig. 1B
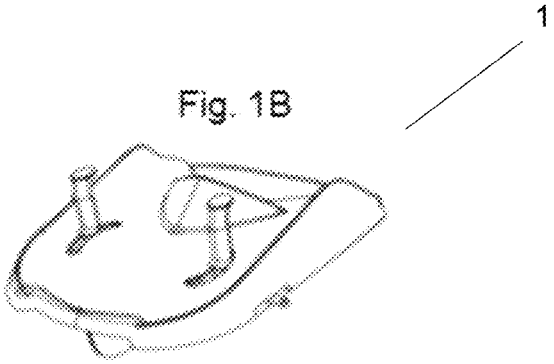
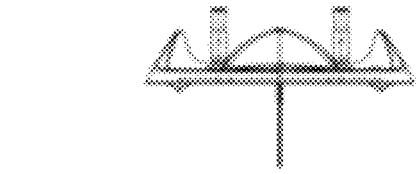
Fig. 1C
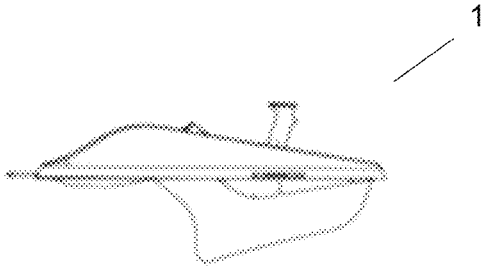
Fig. 1D
Fig. 2A
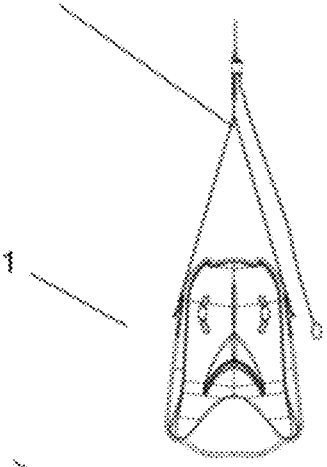
Fig. 2B
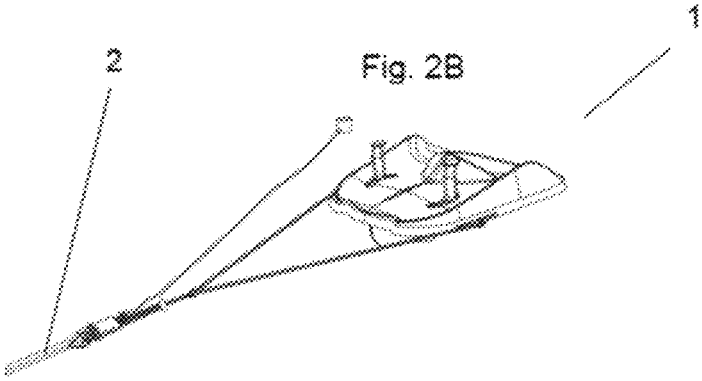
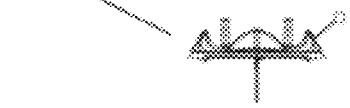
Fig. 2C
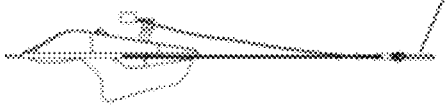
Fig. 2D

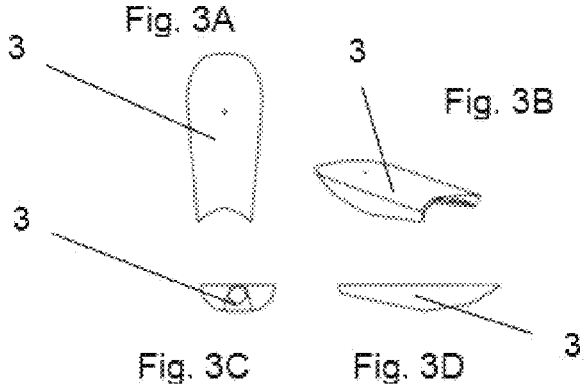
Fig. 3A
3
3
Fig. 3B
3
3
Fig. 3C
Fig. 3D
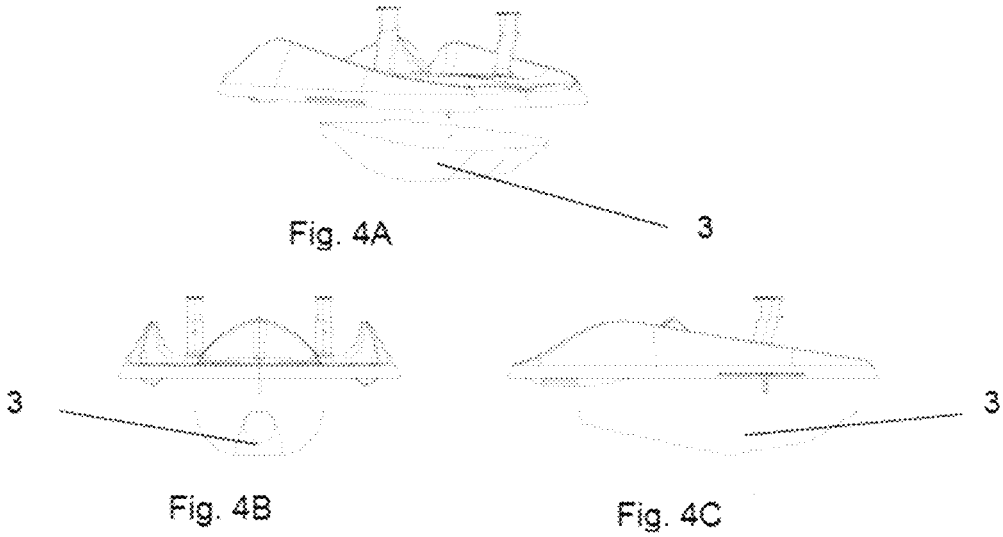
3
Fig. 4A
3
3
Fig. 4B
Fig. 4C

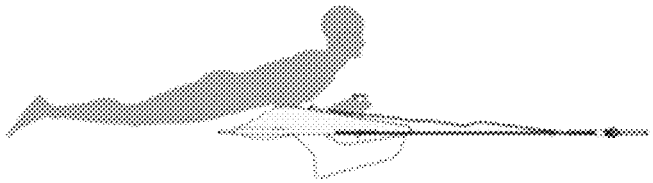
Fig. 7A
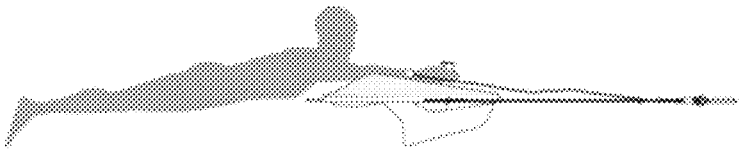
Fig. 7B
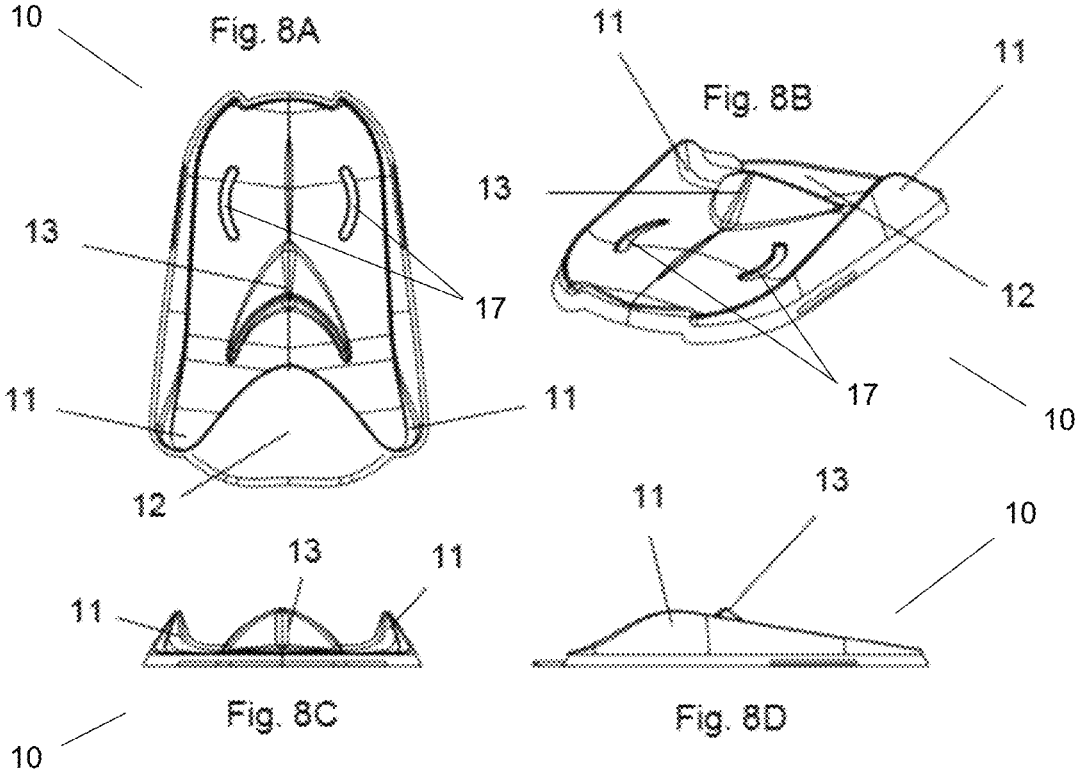
Fig. 8A
Fig. 8B
Fig. 8C
Fig. 8D

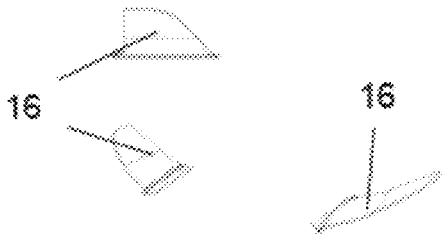
Fig. 15A
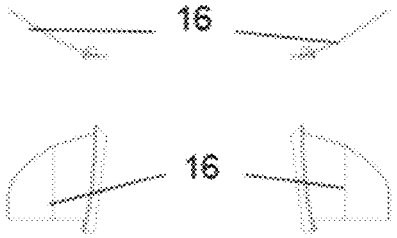
Fig. 15B
Fig. 16A
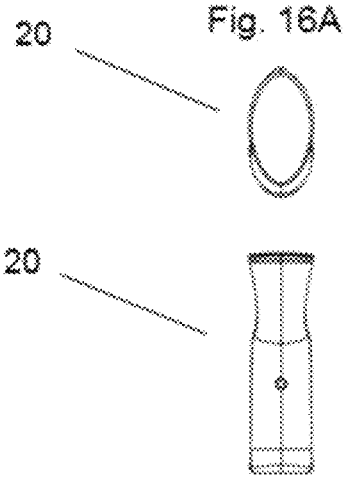
Fig. 16C
Fig. 16B
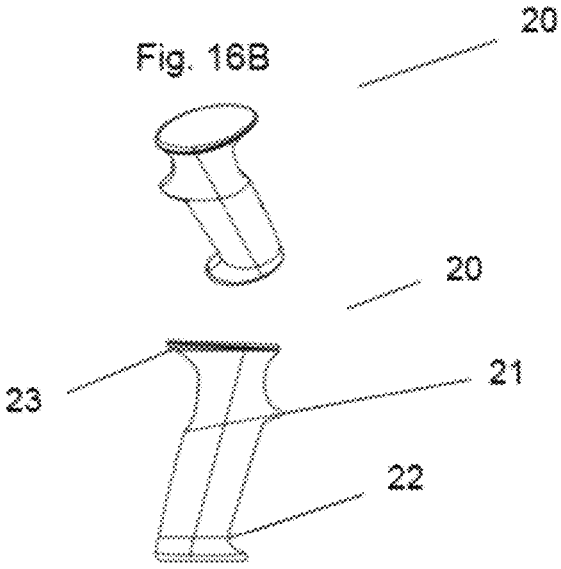
Fig. 16D

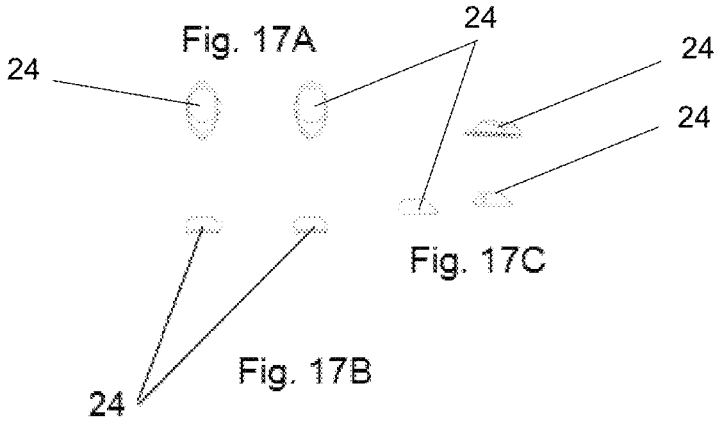
Fig. 17A
Fig. 17B
Fig. 17C
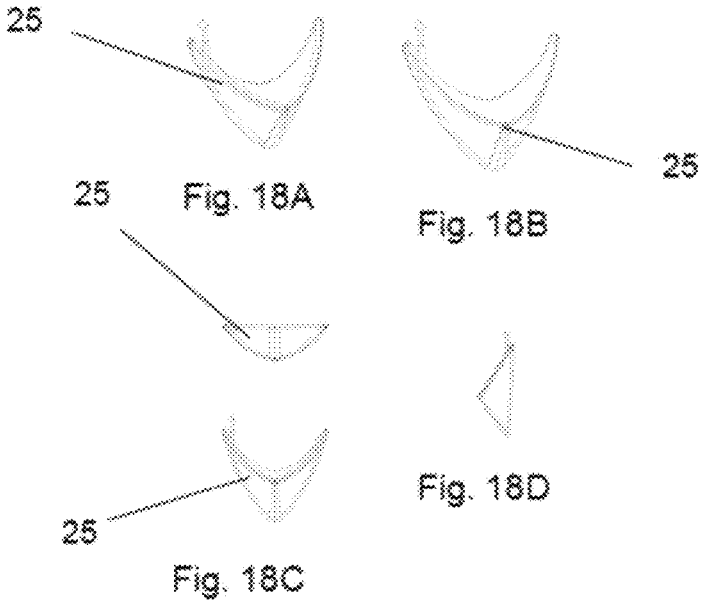
Fig. 18A
Fig. 18B
Fig. 18C
Fig. 18D

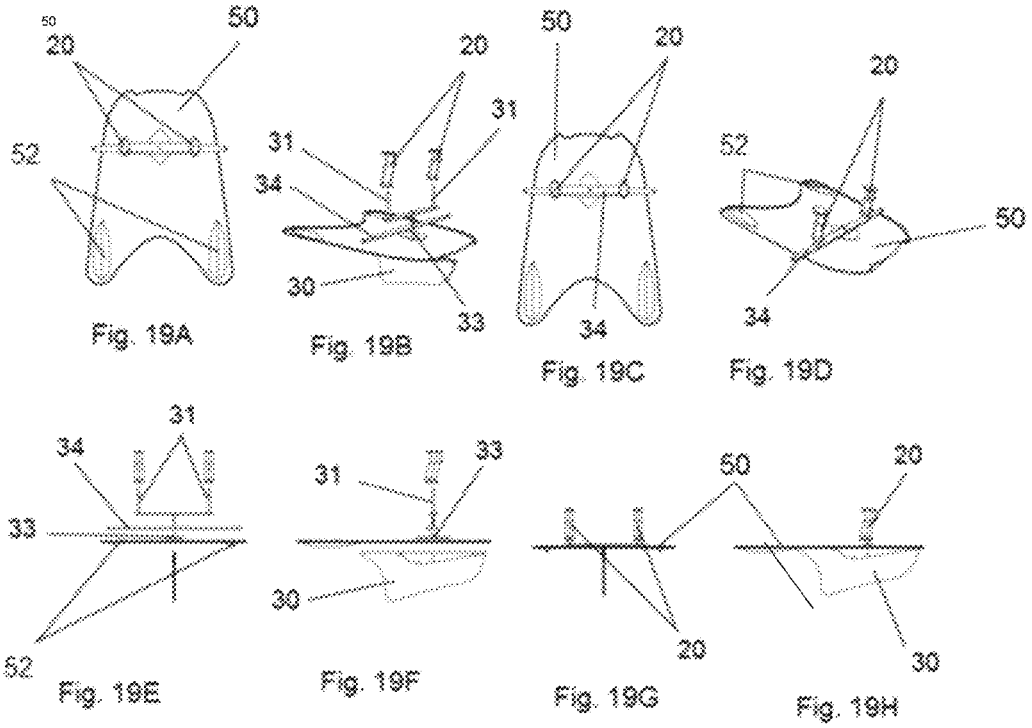
50
20
50
52
Fig. 19A
20
31
31
34
30
33
Fig. 19B
50
20
34
Fig. 19C
20
52
50
34
Fig. 19D
31
34
33
52
Fig. 19E
31
33
30
Fig. 19F
50
20
20
Fig. 19G
20
30
Fig. 19H
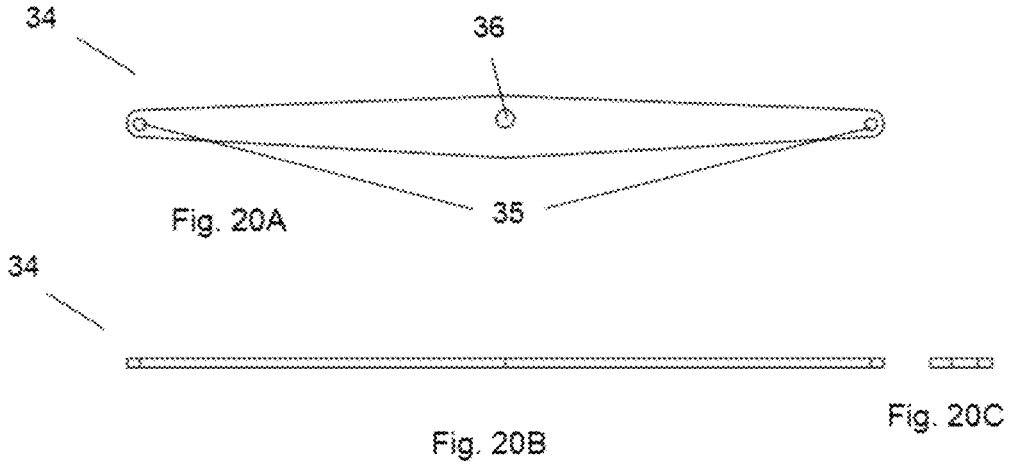
34
36
35
Fig. 20A
34
Fig. 20B
Fig. 20C

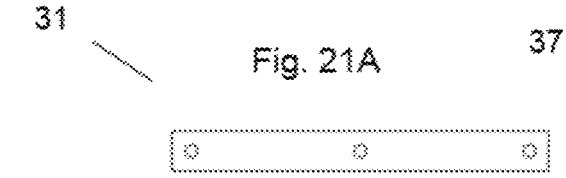
Fig. 21A
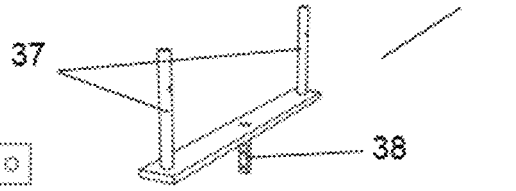
Fig. 21B
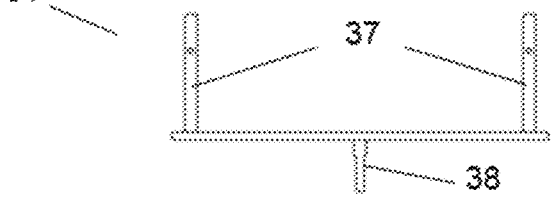
Fig. 21C
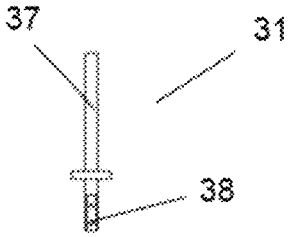
Fig. 21D
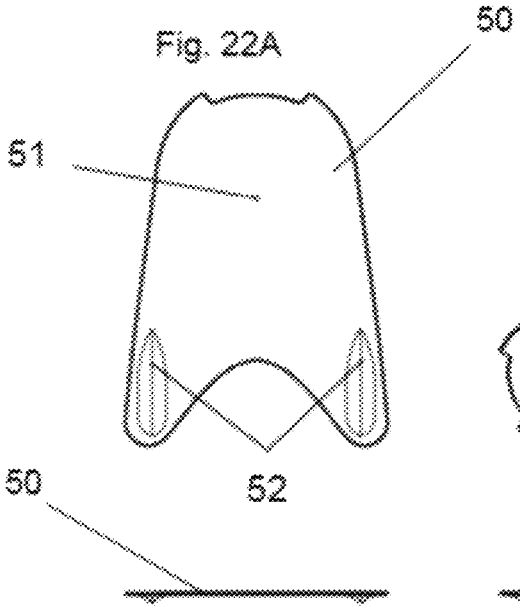
Fig. 22A
Fig. 22C
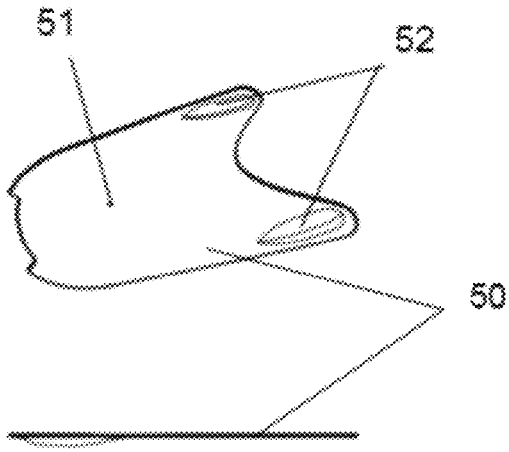
Fig. 22B
Fig. 22D

STRUCTURAL ARRANGEMENT FOR A WATER SKI OR UNDERWATER SKI

BRIEF SUMMARY OF THE INVENTION

The present application refers to a structural arrangement on a water and underwater ski propelled by vessels, with the object to practice maneuvers on or under the water surface, also popularizing the practice of a recently introduced sport, i. e. underwater wake body board.

In the market of water skis propelled by external elements, most devices are currently designed only for use over water. All of them have the characteristic to be propelled by a vessel or impellers, thus enabling maneuvers to be performed during the drive. More recently, a new application has been given to those skis, adding the feature of underwater submersion. They also provide for maneuver performance during submersion.

However, water and underwater skis are currently becoming obsolete, since only small improvements have been performed to the general functionalities of the device. As for background information, we can verify that most documents are found in the last decade and century; some inventions are changes to their ornamental set, for Industrial Design registrations, and not with such a high degree of invention development to provide enhancements to all the aspects of water and underwater devices. Therefore, the application of new improvements for that device is mandatory, for safety, convenience and functionality purposes, as well as for the performance of the device.

Structural arrangements for water and underwater ski are available in the state of the art with practically the same features and few improvements in the field. Changes are more intense concerning the cowl projects for the device, i. e. its design. The state-of-the-art patents concerning the object as presented herein include some common features, which are basic for all ski devices, and there are also more specific features resulting in improvements.

Patent document BR 0603313-0 by the same inventor as the most relevant state of the art, concerning the requirements necessary to reach a patent. The old patent document was filed in 2006 and discloses the contents of a product with not so recent technologies, and the applicant also has large technical knowledge on the subject, as acquired throughout these years.

The content presented by the above mentioned patent document, BR 0603313-0, refers to a water and underwater ski having a few relevant details against the newly developed product, such as ergonomic handles, helm, a handlebar, a centralized lashing point and a lower water bumper. Generally speaking, said items are commonly used in structural arrangements for water/underwater skis, and have become almost indispensable. They also have elements such as supports for the elbows and a sun visor, which are features found in the new product, but it is still possible to identify a widely varied use of these elements concerning the product at issue.

We can also mention patent document US 2011053442, disclosing a structural arrangement in the water ski field, having features such as handles, although non-ergonomic, a centralized lashing point and a non-maneuverable helm. Generally speaking, said structural arrangement for a ski is very basic, even more for a recent product.

We can also mention patent document BR 02022120-0, disclosing a structural arrangement characterized by being similar to a jellyfish. It is a board which may be towed by a vessel, allowing the diver to immerse. The diver introduces his or her hands into the maneuver slit, to allow performing maneuvers while immersed.

However, even being aware of the relevant state of the art, we can state that there are many structural and technological differences between said products and the ski to be explained by this patent document. So far, it is possible to identify little development in this market field, and products which are compatible with current technologies must be added to meet the demand for a high quality product. Safety systems, unique ergonomic handles, improvements to the device performance and functionality, considering non-evident or obvious applications, are a part of the developed devices.

The object presented by this description consists of a structural arrangement to a water and underwater ski for safer and more effective practice of underwater wake body board, allowing for performance improvements by users in sport practice. Designed by persons working in the water and underwater ski field for many years, the structural arrangement as created includes various improvements, with the object to enable users to enjoy, as much as possible, the particularities which may be provided by the underwater wake body board. Similarly, there are also solutions for recurrent problems impairing a better use of the device during sport practices, since the device must reach good performance both over and under the water.

One characteristic of the object as disclosed by the present patent document is the structural arrangement applied to a water and underwater ski by adding new and different items providing ski independence from other pulled vehicles, such as speedboats. It is also characterized by including a cowl system and cowl extensions providing for better performance and comfort; added to a personalized steering system and an imperative safety system, resulting in a unique model in the current market of water and underwater skis. Furthermore, instruments are included to help the ski to perform certain features.

BRIEF DESCRIPTION OF THE DRAWINGS

The disclosure below and related figures, as examples, will facilitate the understanding of the present application.

FIGS. 1A, 1B, 1C and 1D respectively show the upper, perspective, front and side views of the water and underwater ski.

FIGS. 2A, 2B, 2C and 2D show various views of the water and underwater ski, highlighting the cable which is used to connect the ski to the vessel with the safety device.

FIGS. 3A, 3B, 3C and 3D show the individual propeller in various views.

FIGS. 4A, 4B and 4C show three views of said individual propeller linked to the water and underwater ski.

FIGS. 7A and 7B show the views of some possible positions wherein the user may enjoy his or her water and underwater ski.

FIGS. 8A, 8B, 8C and 8D show various views of the items constituting the water and underwater ski cowl.

FIGS. 15A and 15B show said wing in different views.

FIGS. 16A, 16B, 16C and 16D respectively show the upper, perspective, rear and side views of the ergonomic handles of the water and underwater ski.

FIGS. 17A, 17B and 17C show various views of the electronic system included in ergonomic handles.

FIGS. 18A, 18B, 18C and 18D show various views of the control panel, which is located next to the driver on the vessel to pull the water and underwater ski, or on another location outside the ski.

FIGS. 19A, 19B, 19C, 19D, 19E, 19F, 19G and 19H show various views of the driven system linked to the shape of the water and underwater ski.

FIGS. 20A, 20B and 20C respectively show the upper, rear and side views of the towing shaft with independent rotation.

FIGS. 21A, 21B, 21C and 21D show various views of the handlebar, which is a part of the driving system for the water and underwater ski.

FIGS. 22A, 22B, 22C and 22D show the upper, perspective, rear and side views of the shape.

DETAILED DESCRIPTION OF THE INVENTION

Figure 5A:
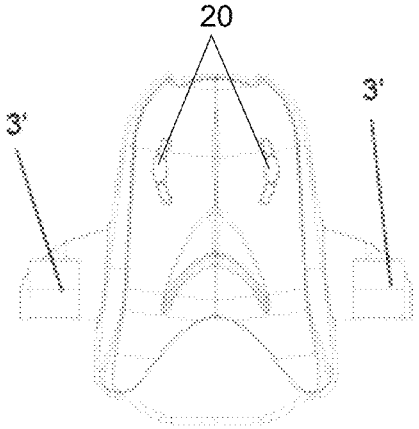
FIGS. 5A, 5B, 5C and 5D show, in various views, the water and underwater ski with a second embodiment of the propeller which is linked to the sides.
Figure 5B:
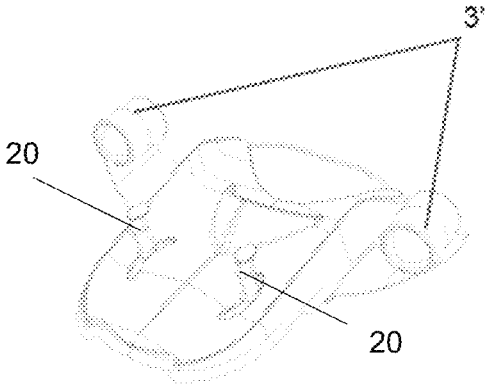
Figure 5C:
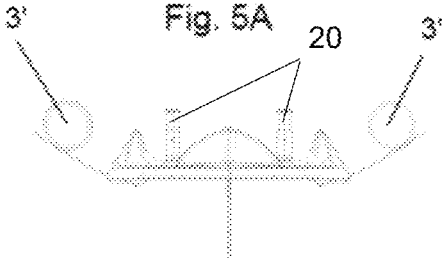
Figure 5D:
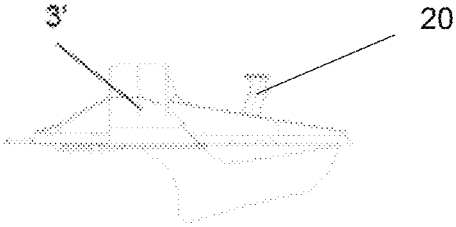
Figure 6A:
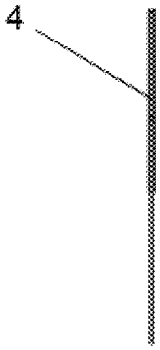
FIGS. 6A, 6B, 6C and 6D show various views of the special helm which is linked to the water and underwater ski.
Figure 6B:
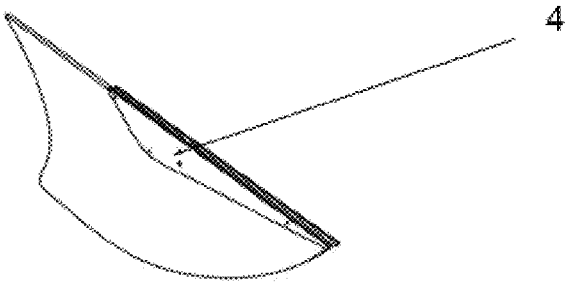
Figure 6C:
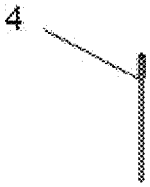
Figure 6D:
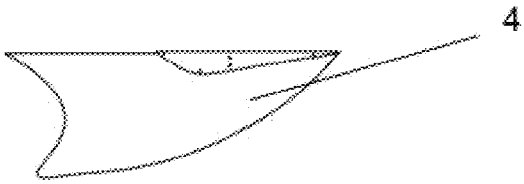
Figure 9A:
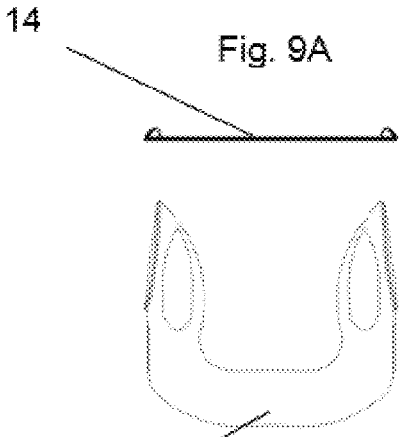
FIGS. 9A, 9B, 9C and 9D show front, rear, upper and perspective views, respectively, of the attachable extension.
Figure 9B:
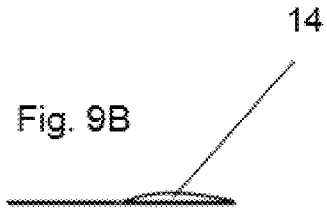
Figure 9C:
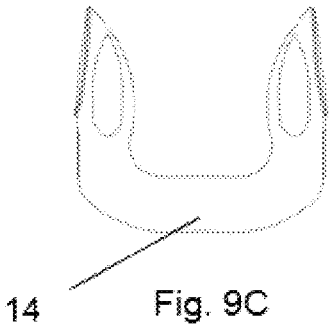
Figure 9D:
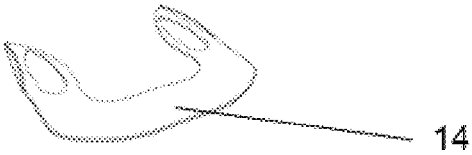

Concerning presented figures, the water and sub water ski (1), represented by FIGS. 1A, 1B, 1C and 1D, has a modern design and a series of items attached to the shape (50) and the ski cowl itself, which will be explained further below. The shape (50) is the base support to which the whole structure is assembled, fixed and attached around that shape (50). It has a hole (51) and receives a fixing plate (33) with a hole (331) concentrically located to the hole (51); a towing shaft (34) also including a hole (36) concentrically located to the other holes is located, and then a handlebar (31) is positioned by its shaft (38) crossing the hole (36) of the shaft (34) and the hole (331) of the plate (33) fixed to the shape (50) and, on the lower surface of the shape (50), a helm is fixed to the shaft (38) of the handlebar (31), also by means of the hole (331) on the plate (33), forming the steering system; and the surface of the shape (50) also includes keels (52) and a cowl (10). These will be explained in detail further below.

As shown by FIGS. 2A, 2B, 2C and 2D, the water and underwater ski (1) may be impelled by boats or impellers, to be pulled by a connection (2), representing the rope and the safety system. There is also the possibility of linking a dedicated propeller (3) to the device, making it become independent from external movement generators, as drawn on FIGS. 3A, 3B, 3C and 3D. There may be one single propeller (3), fitted to the shaft (38) of the handlebar (31), shown in detail further below in FIG. 21, so to provide movement and autonomy to the ski (1), as shown by FIGS. 4A, 4B and 4C. Also, the propeller (3') may be double and attached to the sides of the water and underwater ski (1), as per FIGS. 5A, 5B, 5C and 5D. In both cases, the steering and acceleration of the propeller (3) may be controlled by the user by means of control over the handles (20) of the water and underwater ski (1) being driven by the user, or also by remote control by means of a remote control device (not shown), facilitating its command when no one is aboard the water and underwater ski (1).

Still another way to make the device become autonomous, i. e. not requiring a boat or a propeller (3) to move the water and underwater ski (1), is the use of special helms (4), which are also fitted to the shaft (38) of the handlebar (31). Therefore, as shown by FIGS. 6A, 6B, 6C and 6D, the user has the possibility to rotate the special helms (4) and impel the water and underwater skin (1) forward.

Concerning the visual part of the ski (1), the cowl (10) has a creative and elaborate design, inspired on the body shape of a stingray. It allows the user to remain on the ski (1) during sport practice, providing the loss of contact between the water and the user, thus resulting in a floating sensation at high speed, as per FIGS. 7A and 7B. The cowl (10) has been designed with the object to ergonomically accommodate a human body within the device. FIGS. 8A, 8B, 8C and 8D show the rear side parts of the cowl, with side slopes (11) to accommodate the athlete's arms, providing stability, for allowing the user to remain still on the device. The cowl (10) also includes a plate extension (12) offering better comfort while gliding on the water surface and, since the plate extension (12) has transparent features, it has the same purpose of a sun visor, allowing to see the underwater sceneries while skiing. There is also a water flow sink (13), serving to avoid the formation of water flows against the user's face during the sport practice, as well as the plate prolongation (12), the water flow sink (13) may have transparent features with the same purpose.

Figure 10:
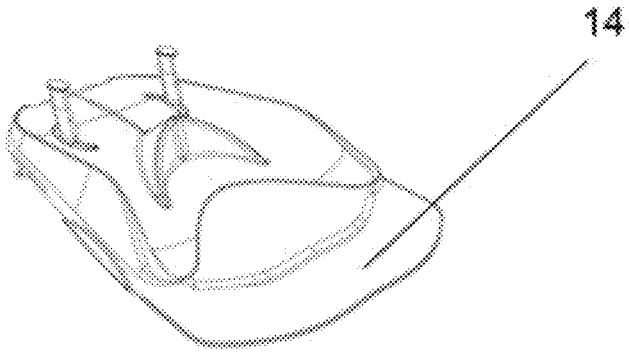
FIG. 10 shows said attachable extension fixed to the water and underwater ski.
Figure 11:
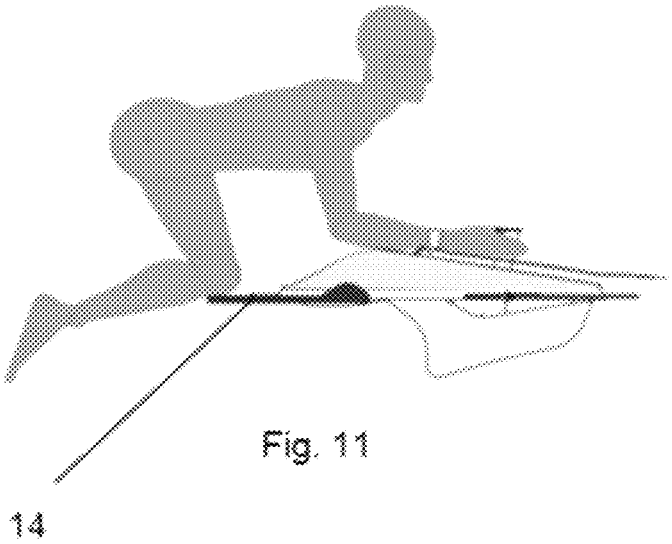
FIG. 11 shows the view of the practicable position with the insertion of the attachable extension as shown by the previous figure.
Figure 12:
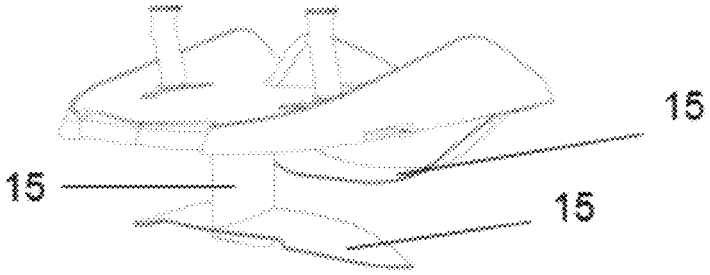
FIG. 12 shows the water and underwater ski with the attached hydrofoil.
Figure 13A:
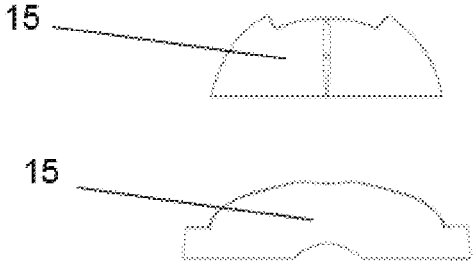
FIGS. 13A, 13B, 13C and 13D show said hydrofoil in different views.
Figure 13B:
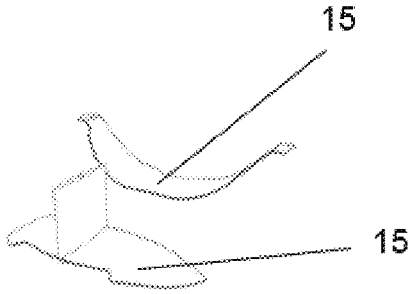
Figure 13C:
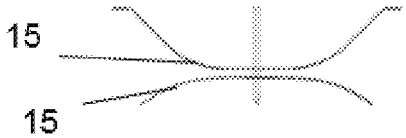
Figure 13D:
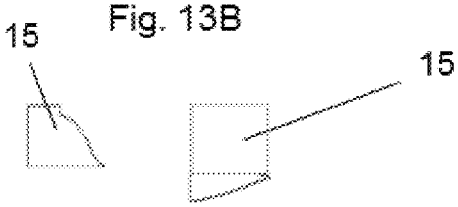
Figure 14A:
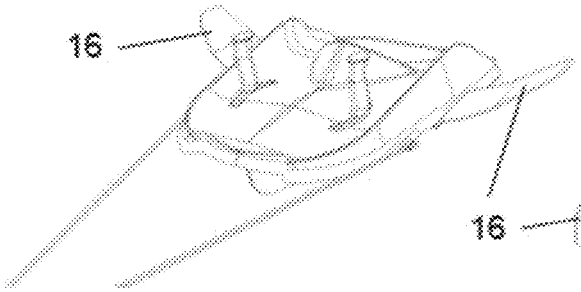
FIGS. 14A and 14B show views of the water and underwater ski with coupled wings.
Figure 14B:
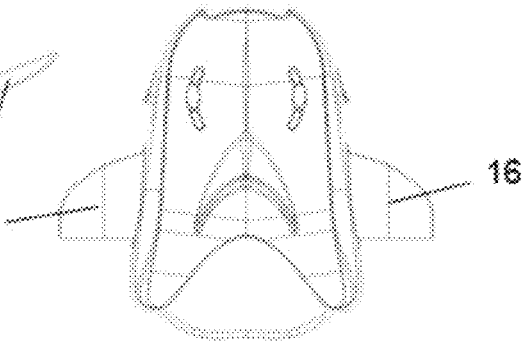
Figure 23A:
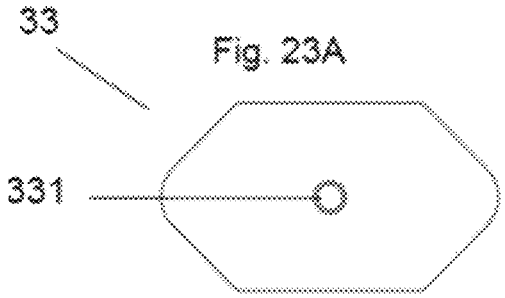
FIGS. 23A, 23B, 23C and 23D show the upper, perspective, rear and side views of the fixing plate for the steering system of the water and underwater ski.
Figure 23B:
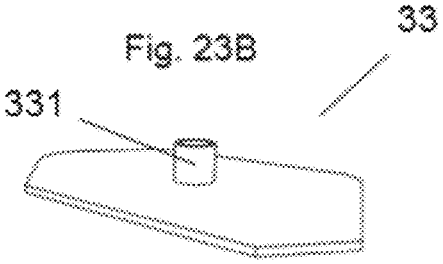
Figure 23C:
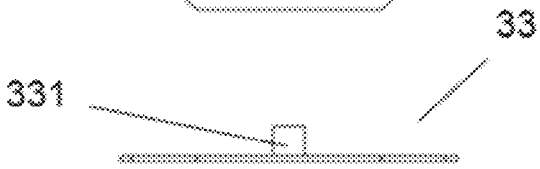
Figure 23D:
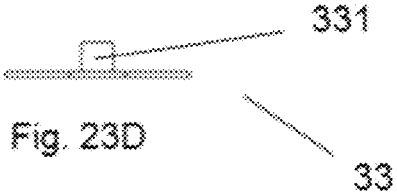

Furthermore, as per FIGS. 9A, 9B, 9C and 9D, the ski (1) has an extension (14) which is attachable to the rear part of the ski for the user to rest his or her knees, thus resulting in better comfort for the user while gliding over the water surface and better maneuver possibilities. That extension (14) linked to the water and underwater ski (1) can be seen on FIG. 10 and its application is shown by FIG. 11. Another detail of the cowl (10) is its form of stamping, which basically expresses the existence of a cowl elevation from the front edge until around the center of the ski, thus providing the hydrodynamic factor required to enable the user to submerge.

Furthermore, on the items attachable to the water and underwater ski (1), there are hydrofoils (15), as shown by FIGS. 12, 13A, 13B, 13C and 13D, which are constituted by two parts, wherein one of those parts is attached to the shaft (38) of the handlebar (31) and the other one is attached to the rear part of the cowl (10) itself. They serve to provide the user with better comfort and the device with better sailing conditions, thus resulting in a gliding sensation on air, i. e. fluctuation.

There is also the possibility to link wings (16) to the sides of the water and underwater ski (1), as presented by FIGS. 14A, 14B, 15A and 15B. Similarly, they are used to enhance device gliding on the water and its underwater sailing conditions by means of hydrodynamic and aerodynamic features as provided.

Inside the cowl (10), the guiding system is located, which is responsible for the whole mechanics and operation of the device when practicing the sport; it may be generically seen on the set of FIG. 19. That system is constituted by two ergonomic handles (20), a handlebar (31), an independently rotating towing shaft (34), a fixing plate (33) for the whole system on the shape (50) and the steerable helm (30). The whole system is connected, i. e. those parts are fitted and fixed by a shaft (38), so to constitute the mechanical system responsible for its side movement, elevation and submersion of the device into the sea.

Concerning the ergonomic handlebars (20), as shown by FIGS. 16A, 16B, 16C and 16D, we have improvements to require the user to apply less force and to provide him or her with better comfort during the activity. A protuberance (21) can be found on the handles, separating the index finger from the others. The angle (22) requires less effort from the fingers to control the ergonomic handles (20). A second protuberance (23) is located on the rear part of the ergonomic handles (20), which are designed to enable the water and underwater ski (1) to submerge more easily while its user has his or her arms outstretched. Inside the handles, there is an electronic system (24), as shown by FIGS. 17A, 17B and 17C, to enable communication between the user on the water and underwater ski (1) and the speedboat driver, by means of signals transmitted by the electronic system (24) of data from the user of the water and underwater ski (1), which are sent to the control panel (25) located close to the speedboat driver or even on another well-known point, such as a beach, dock, etc. The control panel (25) is shown by FIGS. 18A, 18B, 18C and 18D.

As shown by FIGS. 19A, 19B, 19C, 19D, 19E, 19F, 19G and 19H, also referring to the steering system for the water and underwater ski (1), the helm (30) is located, which may have different versions as previously shown, and is activated by the handlebar (31) rotation, wherein ergonomic handles (20) are inserted, with the purpose to guide the water and underwater ski (1) to the desired route. The same figures also show the inclusion of keels (52) linked to the shape (50), so to give better adhesion and performance speed. There is also an independently rotating towing shaft (34), which may be better observed on FIGS. 20A, 20B and 20C, and has been precisely designed to be solely moved according to the side to which the user steers the device, thus resulting in better side mobility, both when submersed into the water, and also over the water surface. On the edges of the independently rotating towing shaft (34), there are two holes (35) located, wherein the cables which may be connected to a possible vessel to pull the water and underwater ski (1) are inserted. On the central hole (36) of the shaft (34), the whole handlebar (31) structure is inserted, connecting the fixing plate (33). FIGS. 21A, 21B, 21C and 21D show the handlebar (31) in detail, and it is possible to notice the existence of holes on its edges, which are intended to insert bars (37) over which the ergonomic handles (20) are assembled.

The whole steering system is attached by the shaft (38) of the handlebar (31). Concerning FIGS. 22A, 22B, 22C and 22D, a hole (51) is located on the shape (50) itself, which is strategically located, through which the shaft (38) of the handlebar (31) and the whole structure of the steering system passes to move the helm (30).

FIGS. 23A, 23B, 23C and 23D show the fixing plate (33) of the steering system attached to the shape (50). The shaft (38) of the handlebar (31) is also inserted through the hole (331) as shown. Therefore, said plate (33) provides full attachment of the steering system which will be responsible for steering the helm (30), and consequently the trajectory of the water and underwater ski (1).

Figure 24A:
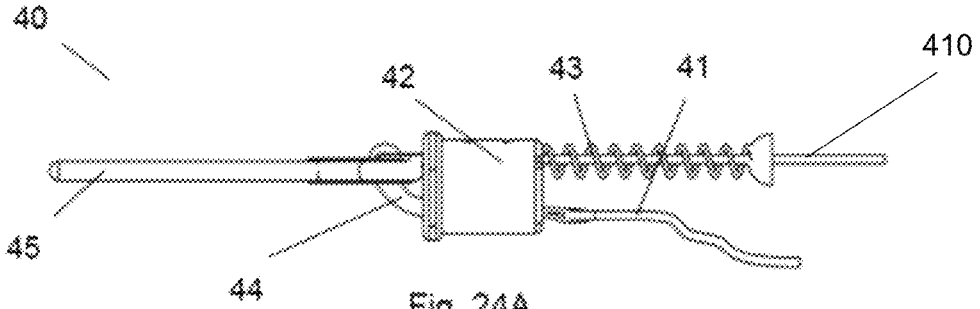
FIGS. 24A and 24B show two views of the operation process for the safety quick release system for the water and underwater ski.
Figure 24B:
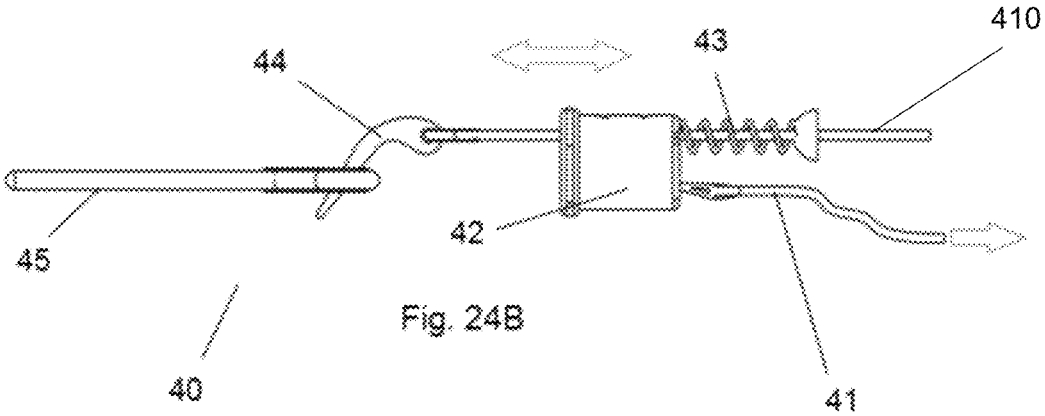

Concerning the safety system (40) offered by the device, represented by FIGS. 24A and 24B, there is a quick disengaging set which is activated by the user himself or herself, known as leash cable (41), which is a rope attached to the ski (1) and to the athlete's wrist. Therefore, whenever the user faces a risk situation, he or she can get free from the vessel, while the safety system works automatically. If the user falls too suddenly from the water and underwater ski (1), the safety system (40) is also immediately activated. The safety system (40), when activated by the leash (41), will cause the disengagement (42) to slide and press the spring (43) of a second cable (410), also attached to the disengagement (42) and to the ski (1). Therefore, the pin (44) fixing the leash (41) to the vessel will be forced to come loose from the cable (45) which is attached to the vessel.

Adding to that, a floatability feature has been applied to the ski, caused by the density difference between the water and the material used to prepare the device. Said floatability feature is important in case of emergency situations, both on the water and in submersion. The device may be of help as support and serve for rescue situations.

Considering all the aspects as mentioned and bearing in mind all the state-of-the-art documents as mentioned, there is a substantial difference between water and underwater ski devices. The present invention provides many benefits in all aspects, such as safety system, steering system, various attachable tools, ergonomic design and many other factors, so to improve the diver's experience during the sport practice.

The invention claimed is:

1. A water ski, useful for wake bodyboarding, comprising:

a base support, a towing shaft is attached to the support, said towing shaft has holes at each end to which cables which may be connected for use by a vessel to tow the water ski, a set of handlebars connected to a central shaft, the shaft passes through a hole in said base support and is connected to a steering system underneath the base support and configured such that the water ski trajectory can be controlled by use of the handlebars, a safety device comprising a rope in which one end is attached to the athlete's wrist and the other end is attached to the ski by way of a safety system, the safety system will automatically detach the rope from the ski when the athlete puts tension on the rope a set of two keels are attached symmetrically to lateral underside of the base support.

2. The water ski as defined in claim 1 further comprising a propeller.

3. The water ski as defined in claim 1 further comprising double propellers located on the sides of the ski.

* * * * *